United States Patent [19]

Forbes, Jr.

[11] 4,017,005

[45] Apr. 12, 1977

[54] CORRUGATED DISCHARGE CONTROL DEVICE FOR A DISPENSER

[76] Inventor: Andrew P. Forbes, Jr., R.D. No. 2, Mount Holly, N.J. 08060

[22] Filed: Aug. 27, 1973

[21] Appl. No.: 388,587

[52] U.S. Cl. ..... 222/47; 222/183; 222/243; 222/515; 222/559; 222/DIG. 1

[51] Int. Cl.[2] ..... B67D 5/08

[58] Field of Search ..... 222/243–244, 222/246, 408.5, 559, 561, DIG. 1, 199–200, 198, 409, 404, 515, 183, 502–503, 485, 47; 259/112–113; 241/263–265

[56] References Cited

UNITED STATES PATENTS

| | | | |
|---|---|---|---|
| 29,689 | 8/1860 | Green | 222/244 X |
| 488,846 | 12/1892 | Snell et al. | 222/561 X |
| 854,411 | 5/1907 | Fairchild | 222/246 X |
| 1,503,770 | 8/1924 | Smith | 241/263 X |
| 2,134,141 | 10/1938 | Moore | 222/243 X |
| 2,176,562 | 10/1939 | Rose | 222/243 X |
| 2,989,008 | 6/1961 | Lindstrom | 222/561 X |
| 3,013,703 | 12/1961 | Hunt | 222/200 X |
| 3,199,745 | 8/1965 | Hollis et al. | 222/324 |
| 3,415,423 | 12/1968 | Bowser | 222/244 |
| 3,501,065 | 3/1970 | Altmann et al. | 222/DIG. 1 |
| 3,520,445 | 7/1970 | Hansen | 222/DIG. 1 X |
| 3,547,077 | 12/1970 | Sage | 222/DIG. 1 X |
| 3,692,403 | 9/1972 | Turner | 222/199 X |
| 3,806,003 | 4/1974 | Fujimoto | 222/DIG. 1 X |

FOREIGN PATENTS OR APPLICATIONS

| | | | |
|---|---|---|---|
| 215,203 | 5/1961 | Germany | 222/243 |
| 1,126,197 | 9/1968 | United Kingdom | 222/DIG. 1 |

*Primary Examiner*—Robert B. Reeves
*Assistant Examiner*—Charles A. Marmor
*Attorney, Agent, or Firm*—Thomas A. Lennox

[57] ABSTRACT

A dispenser is provided to supply fine particulate to xerographic machines utilizing a reciprocal force to drive the dispensing means and anti-caking arms extending inside the cartridge to reciprocate through the body of particulate. A dispensing means is opposed corrugated members biased together which, on relative reciprocation, cam apart to discharge the particulate.

8 Claims, 10 Drawing Figures

Fig. 3
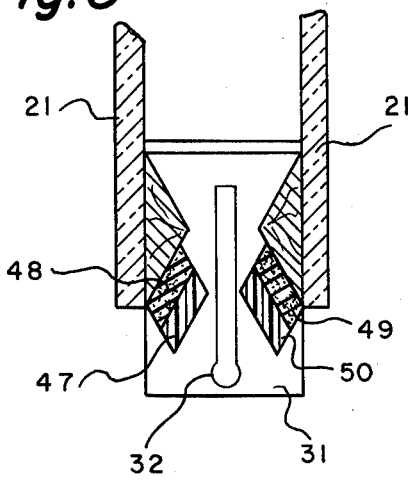
Fig. 5
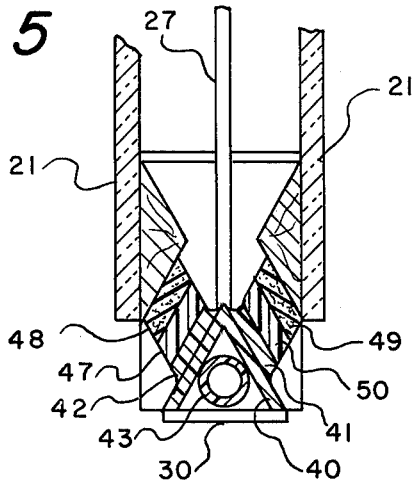
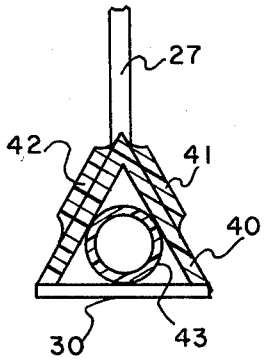
Fig. 4
Fig. 6
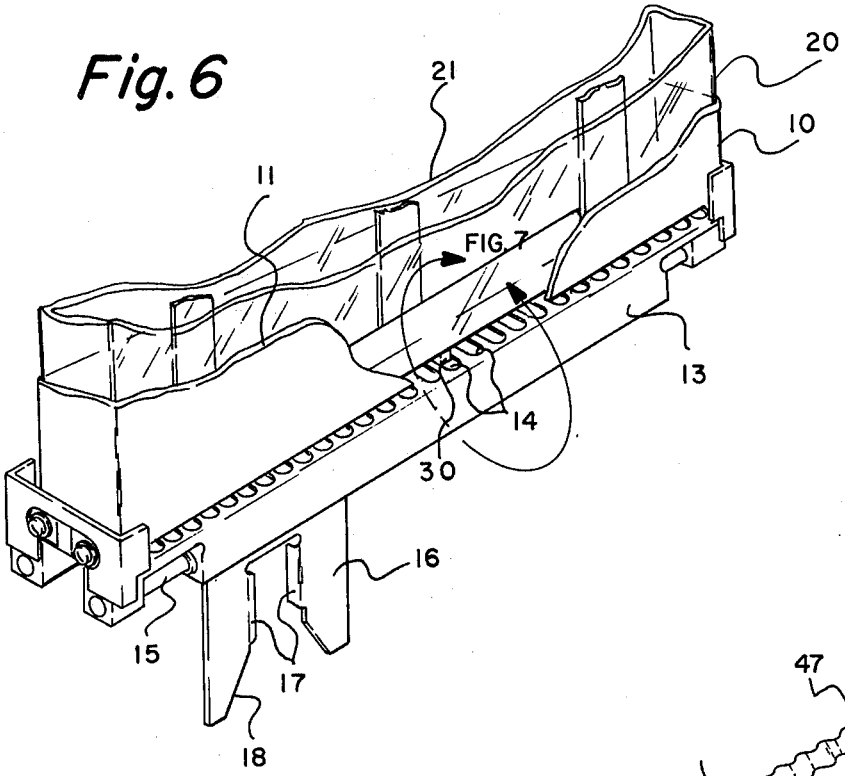
Fig. 7
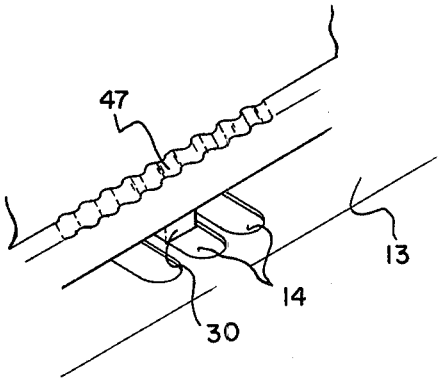

CORRUGATED DISCHARGE CONTROL DEVICE FOR A DISPENSER

BACKGROUND OF THE INVENTION

The handling of fine particulate, particularly that of low density and low specific gravity, has always been troublesome at best and hazardous at worst. A continuing difficulty has resulted in the handling of the ten to twenty micron diameter toner particulate used in xerographic copying machines. This carbon black based toner is not easily poured and when agitated "clouds" and dusts all over the machine and the operator attempting to fill the machine. The air-borne toner fouls the lenses and mirrors of the copying machine thus increasing the amount of service calls required for the machine thus resulting in customer disatisfaction. The well and dispensing mechanism in many xerographic copying machines presently in use is described in a number of U.S. patents, including U.S. Pat. No. 3,692,403 of Sept. 19, 1972 to Turner, U.S. Pat. No. 3,062,109 of Nov. 6, 1962 to Mayo, et al, and U.S. Pat. No. 3,013,703 of Dec. 19, 1961 to Hunt. This type of dispenser is charged by pouring the toner particulate from a bottle into the well from which it is dispensed by the reciprocal motion of an open grate located at the base of the well.

In addition to the well known difficulties in filling the well from a bottle, the dispensing rate of these machines using the well and grate is not constant causing a continual change of lightness to darkness to lightness. As the dispensing rate diminishes, there is less toner available to the copying apparatus and the prints become lighter and of poorer quality. If the operating instructions are followed, the toner well is stirred thus dispensing the toner at a grossly faster rate for a short period of time. This provides darker printing but also darkens the background thus reducing the contrast. What is needed is a controlled rate of toner flow to provide a balance between the amount of toner needed for darkness of print and lightness of background. This need for better control of dispensing rate is particularly noticeable on long runs of copying the same original. Other remedies have been recommended such as knocking the toner well but these remedies tend to increase the amount of toner in the machine thus darkening the copies for a time, but do not provide a controlled dispensing rate.

Later xerographic machines have been designed with dispensers which eliminate the need for hand pouring of the toner powder. These dispensers utilize a cartridge having a resilient open-called elastomeric roller dispenser utilizing rotational force. This type of apparatus is described in U.S. Pat. No. 3,596,807 of Aug. 3, 1971 to Hudson, et al, U.S. Pat. No. 3,608,792 on Sept. 28, 1971 to Hudson, and U.S. Pat. No. 3,678,897 on July 25, 1972 to Hewitt. While these machines eliminate the necessity of pouring the toner from a bottle, the other short comings of xerographic machines are still present. In addition, there are literally hundreds of thousands of xerographic copying machines presently being used that cannot utilize this later development with the elastomeric roller dispenser.

It is therefore, a primary object of this invention to provide a dispenser for fine particulate.

In addition, it is an object to provide an apparatus for holding and dispensing toner particulate. An object of this invention is to provide a dispenser which yields a continuous controlled feed of fine toner particulate to a xerographic machine so as to prevent large changes in the darkness of copy obtained.

Another object of this invention is to provide a dispensing cartridge which can be placed directly into xerographic and other dry copying apparatus without the necessity of the operator having to handle the toner in any way, thus, preventing clouding, spillage and contamination of the machine or the surrounding area.

An additional object is to provide a toner dispenser which essentially eliminates the problems caused by bridging of the toner particulate which are only partially solved presently by knocking the toner reservoir, stirring the reservoir, and the like.

A particular object of this invention is to provide a toner dispenser with a fine control of dispensing rate such that the particulate is introduced into the copying machine at a controlled rate so as to improve the consistency of the darkness of the copies, particularly over a long run using the same or similar originals.

DESCRIPTION OF THE PRIOR ART

A number of xerographic toner particulate dispensers have been disclosed including U.S. Pat. No. 3,149,760 of Sept. 22, 1964 to Eichorn et al, describing a cylindrical brush to push the particulate through an aperture; U.S. Pat. No. 2,965,266 of Dec. 20, 1960 to Rutkus, Jr., et al utilizing a revolving drum; U.S. Pat. No. 3,622,054 of Nov. 23, 1971 to Davidson utilizing both foam and brush rollers; U.S. Pat. No. 3,659,556 of Aug. 19, 1970 to Mutschler describing a controlled toner dispenser using rollers, a cylindrical brush, a spiral screw, and a paddlewheel; U.S. Pat. No. 3,538,887 of Nov. 10, 1970 to Rueckwald utilizing a conveyor belt; U.S. Pat. No. 3,250,439 of May 10, 1966 to Ferrari et al using a resilient cover-pusher over small apertures.

In regard to the specific dispensing means of this invention, dispensers utilizing grooved or corrugated elements include U.S. Pat. No. 331,403 to Hutchinson describing an oatmeal and grain reduction mill with a groove sided feed-hopper; U.S. Pat. No. 15,918 to Dell in 1856 showing a similar apparatus to Hutchinson; and U.S. Pat. No. 2,004,936 to Dorn et al showing corrugated seats joining to form a hopper which closes off at the base. None of these patents disclose the present invention.

It is hypothesized that the rate of flow changes are caused by the phenomenon known as "bridging". Bridging occurs to a varying degree depending upon the particle size, the particular size distribution, the shape of the particles, the specific gravity of the material, the bulk density of the particulate, etc. Bridging prevents the continuous flow of the particulate to the dispensing mechanism by hanging up in the container and bridging the gap causing starvation and drastic changes in the dispensing rate. This bridging effect problem is common for many dispensers, but is particularly troublesome for xerographic toner dispensers, as the toner particulate is very susceptible to bridging. In particular, the toner dispensers in many of the older xerographic copiers as described in U.S. Pat. No. 3,692,403 and others suffer from bridging in that it is recommended procedure to periodically stir the toner particulate in the well. Substantial changes in lightness and darkness particularly on long runs of copying the same original, can generally be traced to these changes in rate of flow.

SUMMARY OF THE INVENTION

This invention is directed to a dispenser for use in a xerographic copying machine having therein an aperture into which toner particulate is introduced to the internal copying apparatus of the copying machine. In addition, it is directed for use in a copying machine wherein either a reciprocal force source is already provided inside the machine capable of being reached through the same aperture for toner, or that a reciprocal force can be readily provided to the dispenser cartridge.

The dispensing cartridge comprises a housing capable of holding toner particulate and fitting into the cross-section of the aperture in the copying machine. A typical housing has end walls and elongated side walls which co-act to form an elongated opening in the bottom of the housing. A dispensing means located in the bottom of the housing is capable of dispensing toner particulate when subjected to reciprocal motion force. Connected directly to the dispensing means such that it is responsive to the reciprocal motion force is at least one anti-caking arm extending inside the housing such that it is subject to reciprocation through the toner particulate.

A dispensing means comprises a pair of members having opposed corrugated surfaces, said surfaces being biased together in an interfitting relationship with means for providing relative reciprocation of the two members to cam the corrugated surfaces apart to establish dispensing openings between the displaced corrugations. At rest position the apparatus dispenses essentially no particulate.

BRIEF DESCRIPTION OF DRAWINGS

FIG. 3 is a cross-sectional view of the bottom of the cartridge taken along lines 3—3 shown in FIG. 2.

FIG. 4 is a cross-sectional view of a closure member as part of the dispensing means taken along lines 4—4 shown in FIG. 2.

FIG. 5 is a cross-sectional view of the bottom of the container with the closure member in place showing the corrugated members interfitted taken along lines 5—5 as shown in FIG. 1.

FIG. 6 is a partially cut-out perspective view showing the base of a typical toner well in a xerographic machine with a toner dispensing cartridge of this invention seated in place.

FIG. 7 is a close-up view from FIG. 6 showing a foot of the toner dispensing cartridge engaged in the grate of the xerographic toner well.

DESCRIPTION OF PREFERRED EMBODIMENTS

Figure 1:
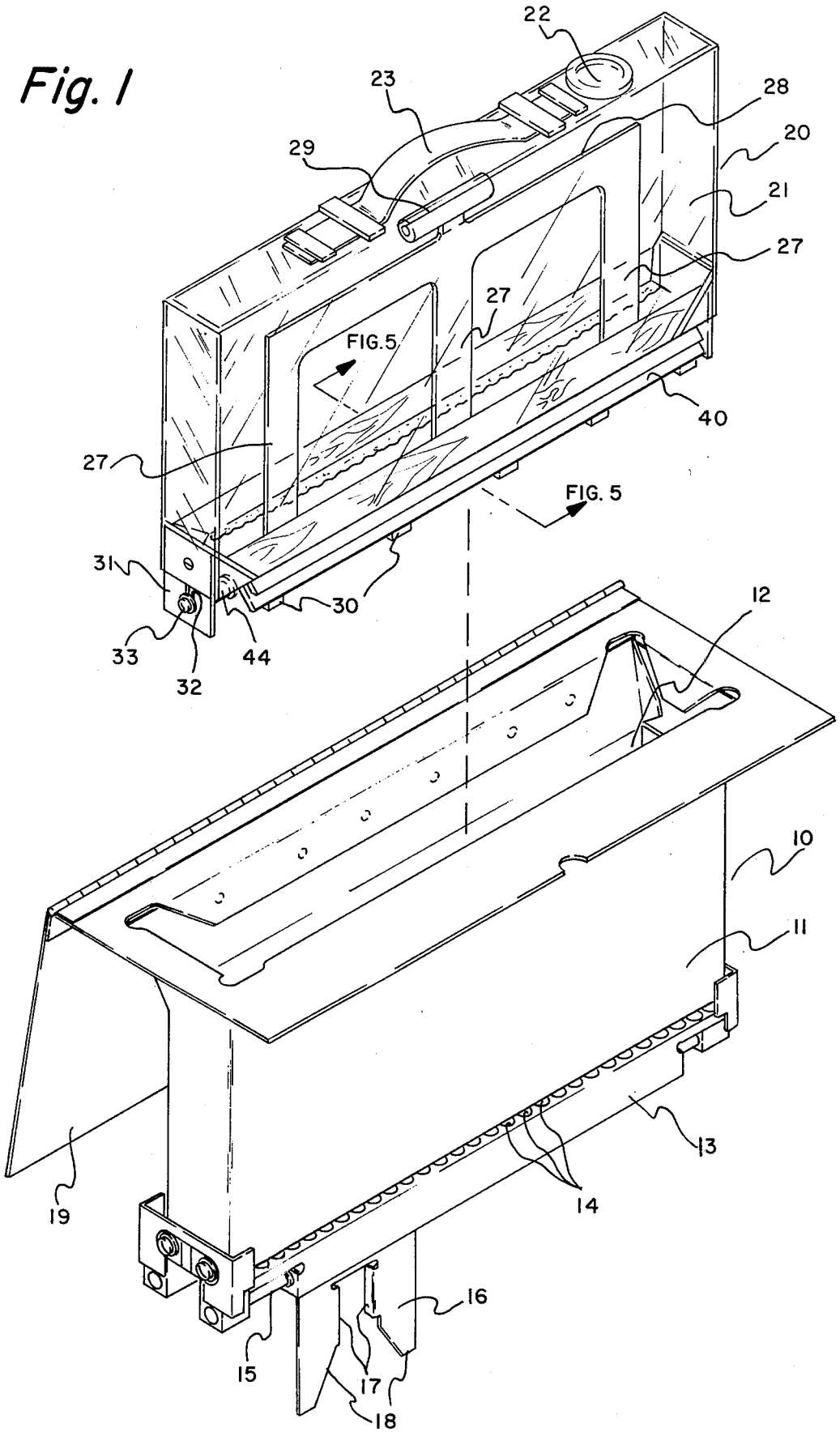
FIG. 1 is a perspective view of a dispensing cartridge of this invention along with an existing xerographic toner welldispenser, into which the cartridge is inserted.

This invention is particularly applicable for use in existing xerographic copying machines wherein a toner dispensing well is provided with an open grate located at the bottom of the well. In existing copying machines this grate is subjected to reciprocal movement to dispense toner particulate to the internal copying apparatus. This invention provides all of the advantages listed hereinabove without the necessity of modifying the existing copying machine at all. In this embodiment the container is constructed to fit into the horizontal cross-section of the well and the transmitting means to provide reciprocal force to the dispensing cartridge comprises at least one foot to engage in one of the openings of the grate such that the foot and, therefore, the dispensing cartridge mechanism is subjected to that same reciprocal movement. It is preferred that at least 2 feet be provided to engage in the grate to improve the balance of the dispensing cartridge.

A preferred embodiment of the toner dispensing cartridge comprises a housing having end walls and an elongated side walls for retaining the particulate, wherein the end walls and the side walls co-act to form an elongated opening at the bottom of the housing. The dispensing means is located at the bottom of the housing and generally within the elongated opening. The preferred dispensing means comprising at least one pair of corrugated members biased into an interfitting relationship in the rest position. At least one of these members is springably loaded, preferably by attachment to a resilient or an elastomeric polymer foam which causes the corrugated surfaces to bias together. This resilient foam may be attached directly to the housing or it may be attached to a closure member fitting in the elongated opening at the botttom of the housing. Of course, the polymeric foam may be provided behind both corrugated members, but it is preferred that one of the members be held rigidly. Extending from the closure member is an energy transfer means to provide reciprocal motion to the closure means to dispense the particulate. When the xerographic copying machine is equipped with a well and dispensing grate at the bottom of the well, it is preferably at least two feet which engage directly into the openings of the grate. Thus, when the grate is reciprocated, the closure member is similarly reciprocated causing the particulate to dispense into the well and thus to the copying mechanism. Attached to the closure member is at least one anti-caking arm extending generally vertically inside the container and preferably to the top of the container. It is preferred that at the upper end of the anti-caking arm a projection be provided which will actually touch the inside surface of the top of the container. Inasmuch as the toner particulate will completely coat and black-out the inside surface of the container, the touching of this projection will wipe a track on the inside surface when the anti-caking arm is reciprocated along with the closure member. Thus, when the machine is in operation and the transfer means is properly engaged in the grate of the dispenser well of the machine, it is a simple matter to observe whether the dispensing cartridge of this invention is reciprocating properly. The projection touching the inside of the top of the container may be typically composed of elastomeric polymer foam or merely an elongated flexible tip which will wipe a track in the polymer disposition. In addition, it is preferred that at least two stabilizing arms be attached to the anti-caking arms, said stabilizing arms extending generally in a horizontal direction to approach and possibly touch the side walls of the container. These stabilizing arms will tend to center the anti-caking arms within the container and aid in preventing "bridging" of the toner particulate. These stabilizing arms should be resilient and beveled so as to provide a minimum of friction as they move through the toner particulate and if they touch the interior side walls of the container.

The anti-caking arms should be designed so as to provide the minimum of friction as they move through the toner particulate. Thus, it is preferred that they be beveled and sharpened on the edges to facilitate flow.

FIG. 1 shows a toner dispenser of this invention equipped to receive the reciprocal force directly from the grate at the bottom of a standard toner dispenser well 10 of a typical xerographic copying machine. The dispenser well fits in and is rigidly attached in the aperture of the xerographic copying machine. Well 11 is generally filled with toner particulate through opening 12 when the present invention is not used. At rest little or no toner is dispensed, however, when grate 13 is reciprocated while riding along rod 15, the toner particulate is dispensed through openings 14 in the ladder at the edges of the ladder. Reciprocating force is applied to extension 16 on bearing surfaces 17. Extension 16 is provided with angled surfaces 18 which allow engagement with the reciprocating force source regardless of the position the rack upon insertion. Cover 19 is normally used to limit the toner particulate from escaping the well, but it may be used to hold a toner dispenser of this invention firmly in place.

Toner dispenser 20 is shown having container 21 which may be filled with toner particulate through opening 22. Container 21 is preferably composed of thermoplastic polymer which may be injection molded or thermoformed and is relatively rigid at room temperature. Although polypropylene, or polythylene is preferred, other polymers such as polyacrylonitrilebutadiene-styrene, polyfluorocarbons, polystyrene, polymethyl methacrylate, and the like may be used. It is preferred that container be at least highly translucent so that the reciprocal movement may be observed by an extension touching the inside surface of container 21. In some of the embodiments of this invention, insertion of some of the parts into container 21 requires that the container be deformed somewhat so that the more flexible polymers such as polyethylene and polypropylene are preferred. Dispenser 20 may be held and removed by handle 23. The bottom of container 21 is closed off at the bottom by closure member 40 on which is located part of the dispensing apparatus. Closure member 40 is capable of reciprocation along rod 44. Attached directly to closure member 40 are anti-caking arms 27 which are rigidified by supporting arms 28. Attached to the anti-caking arm 27 is projection 29 which is painted a bright color and is close to the upper inside surface of container 21 so as to be visible through the top of container 21 showing whether anti-caking arms 27 are in reciprocal motion. Attached to closure member 40 are feet 30 which engage directly in grate openings 14 when the dispenser is placed in opening 12. Therefore, when reciprocal force is placed on bearing surfaces 17, grate 13 reciprocates causing feet 30, closure member 40 anti-caking arms 27 and visual projection 29, all to reciprocate in a similar fashion.

Figure 2:
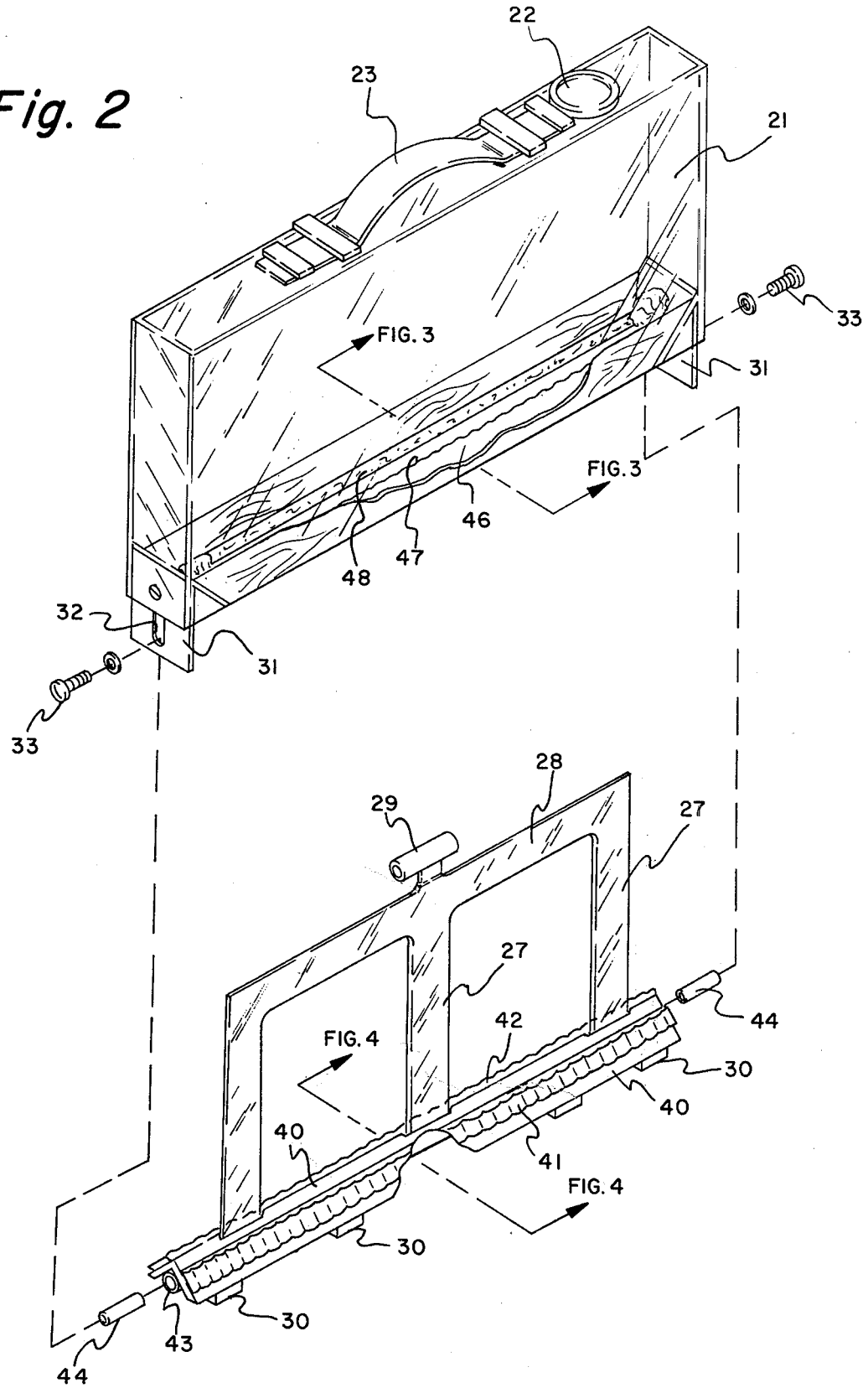
FIG. 2 is an exploded perspective view of a dispensing cartridge of this invention.

FIG. 2 is an exploded view of a toner dispenser of this invention 20, as shown in FIG. 1. This dispenser consists of container 21 having enlarged elongated opening 46 at the bottom. On the sides near the bottom of the container a strip of resilient polymeric foam 48 is adhesively attached onto which is directly adhesively attached corrugated strip 47, such that it is springably loaded. The resilient polymeric foam may be either open or closed cell type and may be composed of a number of polymeric materials, both thermoplastic or thermoset, including polyurethane, polybutadiene, polyvinyl thermasol, and the like. Polyurethane is preferred. The adhesive attachment between foam 48 and container 21 as well as the adhesive attachment between corrugated strip 47 and foam 48 is not critical and may be accomplished by two sided pressure sensitive adhesive tape. A similar foam strip and corrugated strip are located on the opposite side of the opening. They are not shown in this drawing but are pictured in the cross-sectional view of FIG. 3.

Closure 40 is shown placed in opening 46 such that corrugated strips 41 and 42 engage the respective corrugated strips resiliently attached to container 21, that is corrugated strips 47 and 50 (shown in FIGS. 3 and 5). Anti-caking arms 27 and visual extension 29 are placed within the container and the entire closing element rides on rods 44 extended into tube 43. The positioning and pressure of the closure and dispensing means is adjusted by bolt 33 through slot 32 on extension 31 so that rods 44 may be moved vertically and held in place.

FIG. 3 is an expanded cross-sectional view taken along lines 3—3 of FIG. 2 showing the part of the dispensing means attached directly to container 21. Foam strips 48 and 49 are adhesively attached to container 21 and corrugated strips 47 and 50 are adhesively attached to the corresponding foam strips such that the corrugated strips are springably loaded.

An expanded sectional view of closure member 40 as shown in FIG. 4 taken along lines 4—4 of FIG. 2. Corrugated strips 41 and 42 are rigidly attached to or provided as one piece of closure member 40. Tube 43 is provided so that the entire closure member may ride on rods 44 shown above. Feet 30 are attached directly to the closure member at various intervals so as to directly engage in grate 13 shown above. Although some of the parts of closure 40 are shown as separate pieces, it will be clear that the entire closure member as well as anti-caking arms 27 along with all extensions, supporting arms, etc. may be all molded in one piece. Therefore, closure member 40 including tube 43 and corrugated strips 41 and 42, feet 30, anti-caking arms 27, supporting arms 28 and visual extension 29 may be all molded of semi-rigid or rigid plastic. Typical compositions suitable for this molding including polypropylene, rigid polyethelene, polyacrylonitrile-butadiene-styrene, polystyrene, polyacetate, polyacrylonitrile, polymethyl methracrylate, and the like. Rigid polyethylene and polystyrene are preferred compositions.

FIG. 5 is an expanded cross-sectional view taken along lines 5—5 showing the dispensing mechanism in the interfitted relationship as a combination of the closure means pictured in FIG. 4 and the base of the container shown in FIG. 3. The designation on these parts is identical to that shown in FIGS. 3 and 4. The interfitted pairs of corrugated strips 41–50 and 42–47 are shown.

FIG. 6 is a partial cut-away view of a toner dispenser of this invention in FIG. 1 pictured in place within the toner well of a typical xerographic copying machine showing engagement of a foot 30 in the opening 40 of grate 13.

FIG. 7 is an expanded view of the actual engagement of foot 30 in grate 13 as taken from FIG. 6.

Figure 8:
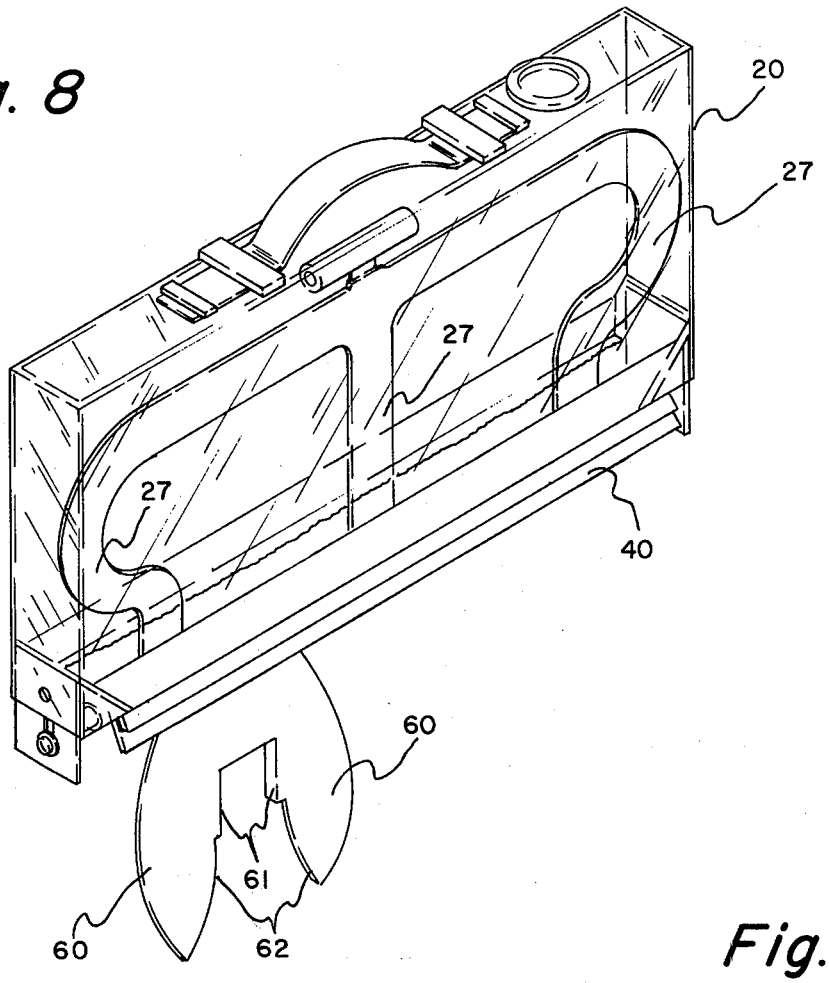
FIG. 8 is a perspective view of a toner dispensing cartridge equipped to directly utilize the reciprocal force source located inside a xerographic copying machine.

FIG. 8 shows an embodiment of present invention wherein dispensing cartridge 20 is equipped to receive reciprocating motion directly from the source within the xerographic copying apparatus, where the typical toner well and dispenser have been removed. Thus, dispenser 20 is equipped with extension 60 having thereon bearing surfaces 61 to respond directly to a rod (not shown) in reciprocal motion. Surfaces 62 are provided to guide the arms 60 into direct engagement with the rod so as to insure engagement with the reciprocal force upon seating of the dispenser.

Figure 9:
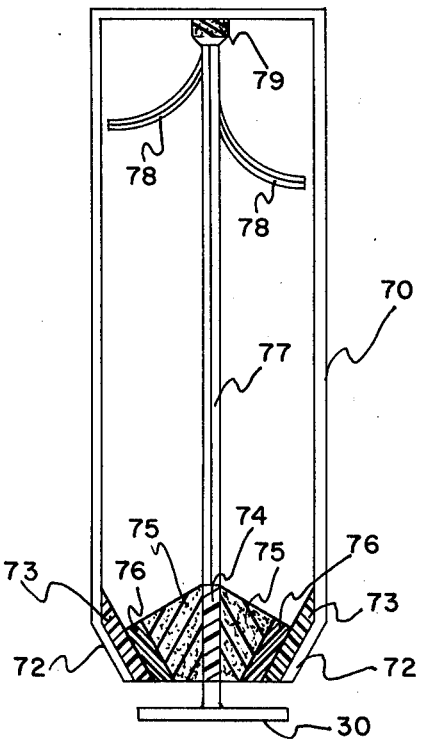
FIG. 9 is a cross-sectional view of an alternate toner dispensing cartridge.

FIG. 9 is a cross-sectional view of a toner dispenser 70 having affixed near the opening at the bottom of container 21 a pair of corrugated stips 73. The strips are angled to provide a seat for closure member 74 by the shape of container at 72. Adhesively attached to closure 74 is a pair of resilient foam strips 75 onto which is adhesively attached corrugated strips 76. In this embodiment it is necessary that container 21 be constructed of flexible, resilient material such that it can be pulled apart to forcibly inert closure 74 and anti-caking arms 77 into the container. In this embodiment stabilizing arms 78 extend generally horizontally from anti-caking arms 77. The stabilizing arms are angled slightly downwardly to facilitate entrance into the container. Extension 79 on the top of anti-caking arms 77 is resilient foam to wipe a track on the inside surface to confirm the reciprocal movement of closure 74. Foot 30 is shown to engage in the typical grate at the bottom of a toner well. In this embodiment foot 30-closure member 74-anti-caking arm combination 77 and 78 may be readily molded in one piece. Anti-caking arm 77 and stabilizing arm 78 are shown beveled on the edges to reduce friction as they move through the toner particulate body.

Figure 10:
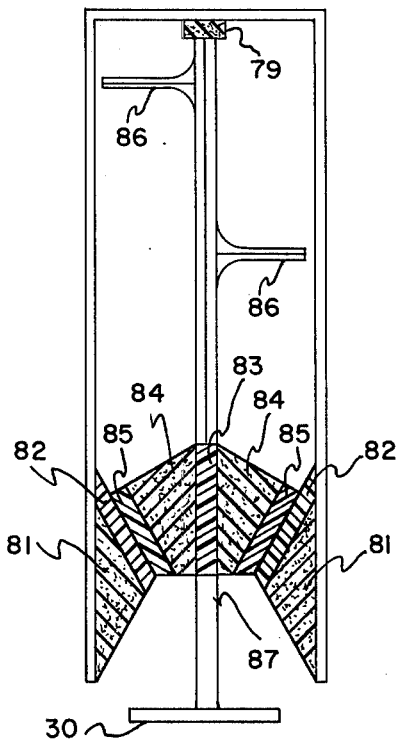
FIG. 10 is a cross-sectional view of another alternate toner dispensing cartridge of this invention.

FIG. 10 is a cross-sectional view of toner dispenser having foam strips 81 affixed near the bottom opening of container 21. On these foam strips are adhesively attached corrugated strips 82 angled to form a seat for closure 83. Adhesively attached to closure 83 are foam strips 84 on which are in turn adhesively attached corrugated strips 85. In this embodiment the angling of foam strips 81 and 84 provides for proper seating of the biased corrugated sheets. Attached to the anti-caking arm are stablizing arms 86 which extend horizontally to almost touch the inside wall of container 21. In this embodiment the stabilizing arms are spaced apart to facilitate entrance into the body of container 21.

Im the dispenser embodiments pictured hereinabove, it is clear that the rate of dispensing the particulate may be controlled by a number of factors. These include the teeth size, both amplitude and wavelength, the degree of pressure exerted to bias the corrugations together, the rate of reciprocation, and the like. This degree of control compares favorably with the present systems which can control the amount of toner dispensed only by the time of reciprocation or revolution.

While great detail has been provided of the preferred dispensing means, there are a number of additional means which have been conceived to discharge the particulate in a satisfactory fashion. These additional dispensing means include two sheets having apertures located such that when the sheets are subjected to relative reciprocation are caused to slide face to face, the apertures will, from time to time, match up to provide a continuous aperture through which the particulate can pass and be discharged. An additional dispensing means is two long brush members aligned tip to tip such that in the rest position, little or no particulate can flow between the brush surfaces. Extensions of the anti-caking arms are caused to reciprocate between the brush surfaces such that openings are provided allowing the particulate to pass between the brush surfaces. An additional dispensing means is a flexible urethane foam sheet generally in the shape of a ladder, with fingers, which may be extensions of the anti-caking arms, extending through the holes between the rungs completely filling the void. When the fingers are reciprocated, the apertures in the foam are deformed such that the toner particulate is dispensed through the openings provided. All of these apparatus are contemplated as substitutes for the preferred dispenser described hereinabove.

EXAMPLE 1.

A standard toner dispenser, part 94896 for use in Model 3600–1 Copier Duplicator manufactured by Xerox Corporation, Rochester N.Y., is filled with approximately one pound of standard toner particulate having a particle size of about 10 microns. This dispenser is similar in design to that disclosed in U.S. Pats. Nos. 3,692,403; 3,602,109; and 3,013,703 listed above. The Xerox 3600 toner dispenser is run continuously until the toner is emptied. The weight of toner is checked every 3 minutes. The dispensing rates obtained is listed on Table 1 under the heading "Standard Xerox 3600 Dispenser".

EXAMPLE 2

A dispenser similar to that pictured in FIG. 2 is filled approximately one pound of the same toner used in Example 1 and is inserted directly into the Xerox 3600 Toner Dispenser of Example 1. The lid is closed to hold the dispenser firmly in place with the teeth engaged in the grate. The same procedure is followed of continuously reciprocating the dispenser and checking the weight every three minutes. The dispensing rate of the dispenser combination is listed in Table I and compared with the results of Example 2.

TABLE I

COMPARISON OF DISPENSING RATE CHANGES WITH AND WITHOUT THE DISPENSER OF FIGURE 2 INSERTED IN A MODEL 3600 XEROX DISPENSER

| | Dispensing Rate (Grams/minute) | |
|---|---|---|
| WGL TONER LEFT IN DISPENSER (GRAMS) | STANDARD XEROX 3600 DISPENSER | DISPENSER OF FIG. 2 INSERTED |
| 450 | 23.5 | 11.5 |
| 420 | 21.5 | 12.0 |
| 370 | 27.0 | 12.0 |
| 340 | 20.0 | 11.5 |
| 280 | 28.5 | 9.5 |
| 150 | 18.5 | 9.0 |
| 60 | 9.5 | 7.0 |

EXAMPLE 3.

The same dispenser of Example 2 is filled with standard toner powder and placed in the standard toner dispenser of a model 3600–1 Copier/Duplicator manufactured by the Xerox Corporation, and allowed to sit overnight. Upon adjustment of the dispensing time, the Copier/Duplicator is caused to run 5000 copies from the same original. The quality of the copies is judged to range from very good to excellent. It is readily observed that the copies do not have the great degree of light to dark variation as is usual in long runs of this type. It is observed that less toner is used and the quality of the copies is better than obtained with the standard copying machine without the dispenser of this invention inserted.

While this invention has been described with reference to the specific embodiments disclosed herein, it is not confined to the details set forth and the patent is intended to include modifications and changes which may come within and extend from the following claims.

I claim:

1. An improved toner dispenser for a xerographic copying machine that is equipped with a toner dispensing apparatus comprising a toner well and an open grate located at the bottom of the well, said grate being subjected to reciprocal movement to dispense toner particulate to the internal copying apparatus, and wherein in the improved toner dispenser, a. an enclosed container capable of holding toner particulate and fitting into the horizontal cross-section of the well, b. a dispensing means in the container capable of dispensing toner particulate when provided with reciprocal motion force, c. at least one anti-caking arm connected directly to the dispensing means responsive to the reciprocal motion force and extending vertically into the container, and d. transmitting means to transmit the reciprocal force from the xerographic machine to the dispensing means and anti-caking arm comprising at least one foot to engage in one of the openings of the grate such that the foot is subjected to the reciprocal movement of the grate.

2. The improved toner dispenser of claim 1 wherein the container is at least translucent to light and a projection is attached to the anti-caking arm, said projection resting against the inside surface of the top of the container such that the resultant reciprocal motion of the projection wipes a path in the deposition of toner particulate on inside surface whereby the reciprocal movement of the mechanism can be confirmed.

3. The toner dispenser of claim 1 wherein the projection is foamed elastomeric polymer.

4. The toner dispenser of claim 1 wherein there are at least three anti-caking arms extending generally vertically inside the container body and wherein two of the arms are positioned such that the reciprocal movement of the arms is in close proximity to the inside surface of the ends of the container.

5. The toner dispenser of claim 1 wherein stabilizing arms extend from the anti-caking arms in a generally horizontal direction to abut against the inside surfaces of the container to aid in centering the anti-caking arms within the container.

6. The toner dispensing container of claim 1 wherein a handle is attached to the top of the container for removal of the container from the aperture.

7. The toner dispenser of claim 1 wherein the dispenser means comprises a pair of members having opposed corrugated surfaces, at least one of said members being springably loaded to cause said surfaces to be biased together in an interfitting relationship, wherein the corrugated surfaces are shaped to allow the corrugations to ride over each other upon reciprocation while being biased together, and the transmitting means provdies relative reciprocation of the two members to cam the corrugated surfaces apart to establish continuous dispensing openings and closings between the displaced corrugations.

8. An apparatus to dispense finally divided particulate comprising, a. a housing having end walls end elongated side walls for retaining the particulate therein, said end walls and side walls coacting to form an elongated opening in the bottom of the housing, b. two elastomeric polymer foam members adhesively attached to the housing on the elongated surfaces at the opening in the bottom of the housing, c. a pair of first corrugated members adhesively attached to the foam strips so as to be springably loaded by the foam, d. a closure member to fit in the opening, e. two second corrugated members affixed to the closure member and positioned such that the corrugated surfaces of the second corrugated members interfit with the corrugated surfaces of the first corrugated members to close off the opening, f. at least one anti-caking arm connected to the closure member and extending inside the container housing, and g. at least one projection means extending from the closure member to a reciprocal force source to provide reciprocal motion to the second corrugated members and the anti-caking arm.

* * * * *